US009143879B2

(12) United States Patent
McElveen

(10) Patent No.: US 9,143,879 B2
(45) Date of Patent: Sep. 22, 2015

(54) DIRECTIONAL AUDIO ARRAY APPARATUS AND SYSTEM

(71) Applicant: James Keith McElveen, Charleston, SC (US)

(72) Inventor: James Keith McElveen, Charleston, SC (US)

( * ) Notice: Subject to any disclaimer, the term of this patent is extended or adjusted under 35 U.S.C. 154(b) by 289 days.

(21) Appl. No.: 13/654,135

(22) Filed: Oct. 17, 2012

(65) Prior Publication Data

US 2013/0101141 A1 Apr. 25, 2013

Related U.S. Application Data

(60) Provisional application No. 61/548,770, filed on Oct. 19, 2011.

(51) Int. Cl.
*H04R 3/00* (2006.01)
*H04S 3/00* (2006.01)

(52) U.S. Cl.
CPC ..... *H04S 3/002* (2013.01)

(58) Field of Classification Search
CPC ..... H04R 3/005; H04R 1/403; H04R 5/027
USPC ..... 381/122–125, 96, 313, 387, 356
See application file for complete search history.

(56) References Cited

U.S. PATENT DOCUMENTS

| | | | | |
|---|---|---|---|---|
| 3,864,666 | A * | 2/1975 | Douglas | 367/126 |
| 3,872,293 | A * | 3/1975 | Green | 708/821 |
| 4,198,705 | A * | 4/1980 | Massa | 367/126 |
| 5,471,538 | A | 11/1995 | Sasaki et al. | |
| 6,600,824 | B1 | 7/2003 | Matsuo | |
| 7,092,539 | B2 | 8/2006 | Sheplak et al. | |
| 7,764,801 | B2 | 7/2010 | Soede et al. | |
| 8,213,634 | B1 * | 7/2012 | Daniel | 381/92 |
| 8,220,334 | B2 * | 7/2012 | Klessel et al. | 73/602 |
| 2005/0195330 | A1 * | 9/2005 | Zacks et al. | 348/564 |
| 2007/0016267 | A1 * | 1/2007 | Griffin et al. | 607/57 |
| 2007/0025562 | A1 | 2/2007 | Zalewski et al. | |
| 2011/0144491 | A1 * | 6/2011 | Sliwa et al. | 600/439 |

FOREIGN PATENT DOCUMENTS

| | | | |
|---|---|---|---|
| WO | WO 2011087770 | A2 * | 7/2011 |
| WO | WO 2011087770 | A2 * | 7/2011 |

* cited by examiner

*Primary Examiner* — Brian Ensey
*Assistant Examiner* — Julie X Dang
(74) *Attorney, Agent, or Firm* — Gregory Finch

(57) ABSTRACT

A directional transducer array system comprising a plurality of transducers with mathematical sequence spacing mounted on an array tile or host device. In an embodiment, the invention allows the construction of a receiving or transmitting, tiled (modular) directional audio array while simultaneously retaining desirable directional characteristics, improving gain, and limiting negative impacts on side lobe attenuation as the array is scaled (i.e. identical or similar tiles are added to or subtracted from the array); and allows the construction of a receiving or transmitting directional audio array that is light weight and robust enough to be used in body-worn, body-carried, vehicular, and fixed installations.

20 Claims, 5 Drawing Sheets

DIRECTIONAL AUDIO ARRAY APPARATUS AND SYSTEM

RELATED APPLICATIONS

This application claims the benefit of U.S. Provisional Application 61/548,770, filed Oct. 19, 2011, hereby incorporated by reference.

PARTIES TO A JOINT RESEARCH AGREEMENT

The presently claimed invention was made by or on behalf of the below listed parties to a joint research agreement. The joint research agreement was in effect on or before the date the claimed invention was made and the claimed invention was made as a result of activities undertaken within the scope of the joint research agreement. The parties to the joint research agreement are DANIEL TECHNOLOGY INC. and JAMES KEITH MCELVEEN.

FIELD

The present invention generally relates to directional audio systems, in particular, to the design, construction and processing of sequence-spaced and tiled directional audio systems.

BACKGROUND

Directional audio systems work by spatially filtering received (or transmitted) audio so that sounds received (transmitted) along the steering direction are amplified and sounds received (transmitted) along other directions are reduced. The reception or transmission of sound along a particular spatial direction is a classic but difficult audio engineering problem. One means of accomplishing this is by use of a directional array of transducers. It is well known by those skilled in the art that a collection of transducers can be treated together as an array to be combined in engineered ways to spatially filter (either when transmitting or receiving) directional sounds at the particular location of the array over time. The classic means of spatial filtering consists simply of manipulating the constructive and destructive interference pattern of the various sounds that pass through the array using some engineered combination of transducer types, array geometry, time delays, phase delays, frequency filtering, amplitude filtering, and temporal filtering to create a directional interference (a.k.a. directivity) pattern. Applications for the remote transmission or reception of audio require operation in many different, challenging environments including not only long distances, but also reverberant and noisy acoustic spaces and scenarios where size, weight, and power restrictions are severe. Limited scenarios have been addressed by prior devices, such as hands-free directional microphones for automobiles, small microphone arrays for computer workstations, hearing aids, modular microphone arrays, and loudspeaker arrays. However, none of these prior devices simultaneously solves the problems inherent in many common scenarios for directional audio systems—namely, size, weight, power, consistent directionality, scalability, and bi-directionality. By scalability, it is meant the characteristic to expand the size (e.g. physical aperture, number of transducers, etc.) of a directional audio system in an efficient manner to increase its effectiveness in or appropriateness for the application without compromising the simplicity, noise performance, power consumption, or architecture. By consistent directionality, it is meant the characteristic of a directional audio system that its directionality not vary significantly over the frequency range of interest. By bi-directionality, it is meant the characteristic of a directional audio system that its architecture can be used to transmit or receive audio, depending on the selection of the type of transducer. Therefore, significant problems remain for prior devices to function effectively in more general cases.

Traditional directional audio arrays by definition selectively receive or transmit sounds situated directly in-line with their (on-axis) look direction and have the ability to reduce sounds received from or transmitted to other (off-axis) directions. A transducer array can be used as a directional audio system and consists of, in its simplest form, a plurality of transducers with appropriate processing of the audio signals from or to the transducers so as to accomplish the formation of a directivity pattern.

Transducer arrays of this type, which use direct summation of the signals at the array of transducers, produce a directivity (i.e. width of the main lobe of the directivity pattern) which depends on the frequency. The directivity also generally depends on the effective dimensions of the array and the acoustic wavelength at the inspected frequency relative to that effective dimension. Therefore, at low frequencies a lesser degree of directivity is achieved and the directivity increases with the frequency.

The lowest wavelength at which a transducer array can provide a certain degree of directivity is dependent on the overall dimensions of the array. The highest frequency at which the directivity pattern does not exhibit spatial aliasing (which causes loss of directional characteristics at high frequencies) depends on the distance between the transducers in the array.

A significant side lobe is generally an undesirable characteristic of an array. In most applications, it is desirable to have minimum side lobes and a highly directional main lobe (traditionally defined as having a beam width of less than or equal to 25 degrees). Side lobes are determined by the number and geometrical configuration of the transducers in the array. It is known by those skilled in the art that if an axis of symmetry can be drawn through the geometrical configuration of the array of transducers, higher side lobes at some or all frequencies will result.

Increasing the size of an array has traditionally been accomplished by appending a duplicate of some, or all, of the existing array, including its spacing. Regardless of which traditional transducer configuration is used (e.g. equal, logarithmic, random, etc.), simply duplicating the existing configuration and appending it to the existing array in the same orientation will automatically result in an axis of symmetry and, hence, increased side lobes for the larger resulting array.

SUMMARY

Several objects and advantages of the present invention are:

(a) to allow construction of a receiving or transmitting, directional audio array that is highly scalable;

(b) to allow the efficient use of a sufficient number of transducers in the directional audio array to simultaneously have high gain, high directivity, and high side lobe attenuation;

(c) to provide consistent directionality of transmitted or received audio across the frequencies of interest;

(d) to allow the construction of a receiving or transmitting, tiled (modular) directional audio array while simultaneously retaining desirable directional characteristics, improving gain, and limiting negative impacts on side lobe attenuation as the array is scaled (i.e. identical or similar tiles are added to or subtracted from the array);

(e) to allow the construction of a receiving or transmitting directional audio array that is light weight and robust enough to be used in body-worn, body-carried, vehicular, and fixed installations;

(f) to allow the construction of a receiving or transmitting directional audio array that is immune to radio frequency (RF) interference, such as from mobile phones;

(g) to allow the construction of a receiving or transmitting directional audio array that is immune to mechanical rubbing noise interference, even when integrated as part of a wearable electronics (i.e. body-worn) system; and (h) to allow the construction of a receiving or transmitting directional audio array with low cost of construction, high reliability, high temperature operation, light weight, and simplicity of operation.

Another object of the present invention is a directional transducer array apparatus comprising a printed circuit board substrate; a plurality of transducers mounted on a surface of the printed circuit board substrate, and arranged in a nested circle configuration with fractal-based spacing between nested circles and the plurality of transducers; at least one input-output connector operably engaged with the plurality of transducers through an electrical bus; and, at least one dual in-line package switch operable to select channel settings on an electronics module.

Yet another object of the present invention is a directional transducer array system comprising an array tile, the array tile being interconnected to one or more identical array tiles and configured such that all axes of symmetry are substantially eliminated in relation to other interconnected array tiles, the array tile comprising a plurality of transducers mounted on a surface of the array tile, a plurality of sound ports in substantial alignment with the plurality of transducers, at least one input-output connector operably engaged with the plurality of transducers through an electrical bus, and, at least one dual in-line package switch operable to select channel settings on an electronics module; and, at least one electrical bus operably engaged with the input-output connector of the array tile and an input-output connector of the one or more identical array tiles.

Still yet another object of the present invention is a directional transducer array system comprising a plurality of transducer mounted on a host device and arranged in a nested circle configuration with fractal-based spacing between nested circles and the plurality of transducers, the plurality of transducers operable to capture and beamform sound waves onto an electrical bus into at least one channel; at least one input-output connector operably engaged with the plurality of transducers through the electrical bus; at least one dual in-line package switch operable to select the at least one channel; and, an electronics module operable to amplify at least one pre-beamformed channel and selectively apply gain control to directional audio produced at an output device.

Still further objects and advantages of this invention will become apparent from a consideration of the ensuing description and drawings.

BRIEF DESCRIPTION OF THE DRAWINGS

In the following, the invention will be described in more detail with reference to the drawings, where.

DETAILED DESCRIPTION

Figure 1:
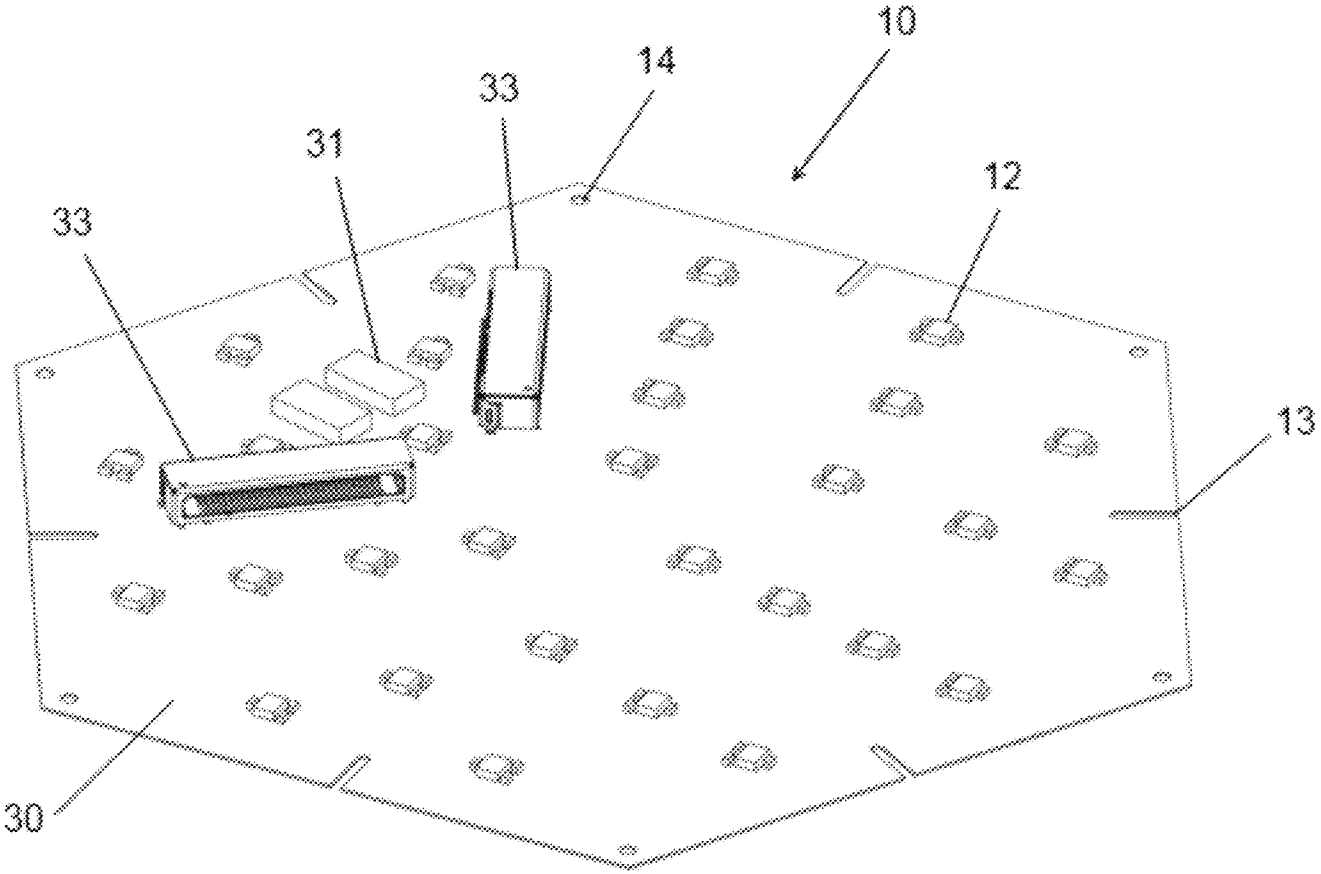
FIG. 1 is an isometric illustration of an embodiment of the invention as a tile.

Reference will now be made in detail to various embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description of various embodiments of the present invention, numerous specific details are set forth in order to provide a thorough understanding of the present invention. In other instances, well-known methods, procedures, protocols, services, components, and circuits have not been described in detail so as not to unnecessarily obscure aspects of the present invention.

According to one aspect of the invention, a system and method for a robust and highly scalable directional audio array is provided. The present invention in its different aspects utilizes a transducer spacing based on mathematical sequences, such as fractal and Fibonacci sequences. Fractals, for example, have the mathematical property of self-similarity at different scales. Simply put, they have the characteristic that they are patterns made of smaller copies of themselves. Extending a fractal sequence by adding copies of itself "grows" the fractal and therefore an axis of similarity can easily be avoided. One aspect of the invention utilizes fractal geometrical patterns in constructing a single directional audio array with desirable directivity, gain, and side lobe properties that are a result of its engineered fractal geometry.

According to another aspect of the invention, a system and method for a robust, modular and highly scalable directional audio array is provided. Tiles of transducers are employed that incorporate the mathematical sequence transducer spacing of the present invention so that as tiles are added to the constructed array, the mathematical sequence of spacing progresses. This aspect of the invention can be quickly assembled into different sizes and configurations which in turn modify the effective pickup pattern of the device—while simultaneously retaining desirable directional characteristics, improving gain, and limiting negative impacts on side lobe attenuation which would normally occur when employing tiled audio arrays. Due to these and associated characteristics, the invention is inherently scalable to larger sizes with little negative impact on complexity and power requirements. Reducing the size of a fractal retains the self-similarity property and as a consequence the invention is also inherently scalable to smaller sizes with less negative impact on array performance than other transducer configurations.

According to another aspect of the invention, a directional audio system consisting of as few as one tile that has mathematical sequence spacing, such as fractal and Fibonacci as examples.

According to another aspect of the invention, a tiled directional array system of similar design to the invention that employs transducer spacing of any method where instead of appending tiles to an existing array configuration in the same orientation, the tiles are rotated in orientation so that there is no axis of similarity in the resulting transducer array configuration. The dimensions of the geometrical shape of the tile are integral to this aspect of the invention. Of the family of regular polyhedrons, only certain kinds can be tiled—namely, squares, rectangles, triangles, and hexagons. Of these, squares, triangles, and hexagons are suitable for this aspect of the invention due to the requirement for rotatable shapes that can also be tiled, although other shapes may also be used that result in sections with materials that overlap or gap when tiled (connect) together.

Referring now to the invention in more detail, in FIG. 1 there is shown an isometric illustration of the preferred embodiment of the invention as a single hexagonal tile 10 as part of a directional audio array.

In more detail, still referring to the invention of FIG. 1, a single tile 10 may function as an array by itself when connected to the electronics module 11.

The construction details of the invention as shown in FIG. 1 are, in its preferred embodiment, is a tile made of flexible printed circuit board (PCB) material 30 with surface mounted microphones 12, two dual in-line package (DIP) switches 31, and two input/output (I/O) connectors 33. The PCB 30 is either a single-sided or two-sided board with its bottom side typically being a metal ground plane. Microphones 12, connectors 33, and DIP switches 31 or other electronic components are typically mounted on the bottom side of the PCB 30. The microphones 12 are typically arranged in a nested circle configuration with fractal-based spacing between the circles and microphones. Each tile also has several holes 14 that go completely through and can be used to interconnect multiple tiles 10 or to mount the tiles 10 to surfaces using bolts, screws, or other fasteners. The microphones 12 are ported to the arriving sound pressure waves through tiny holes that go completely through the tile PCB 30, therefore the electronics are on one side of the tiles 10 while the opposite, smooth side faces toward the sound source(s) of interest and minimizes the potential for rubbing noises against any garment fabric.

The mechanical and electrical interconnection of multiple tiles 10 will be addressed below, including settings of the DIP switches 31.

Other variations on this construction technique may include, but are not limited to, individually wired transducers arranged in the same or similar geometric pattern and mounted on or in a host device; tiles made of other materials, such as hard PCB or even fabric with conductive wires or other substances to electrically connect the transducers to the electronics module, power, and ground; other arrangements of transducers, such as equal, random, Golden Spiral, and Fibonacci spacing; other tile or array panel shapes including triangular and square; and tiles or array panels with vibration or sound absorbing layers of neoprene rubber or similar materials on top and/or bottom.

Figure 2:
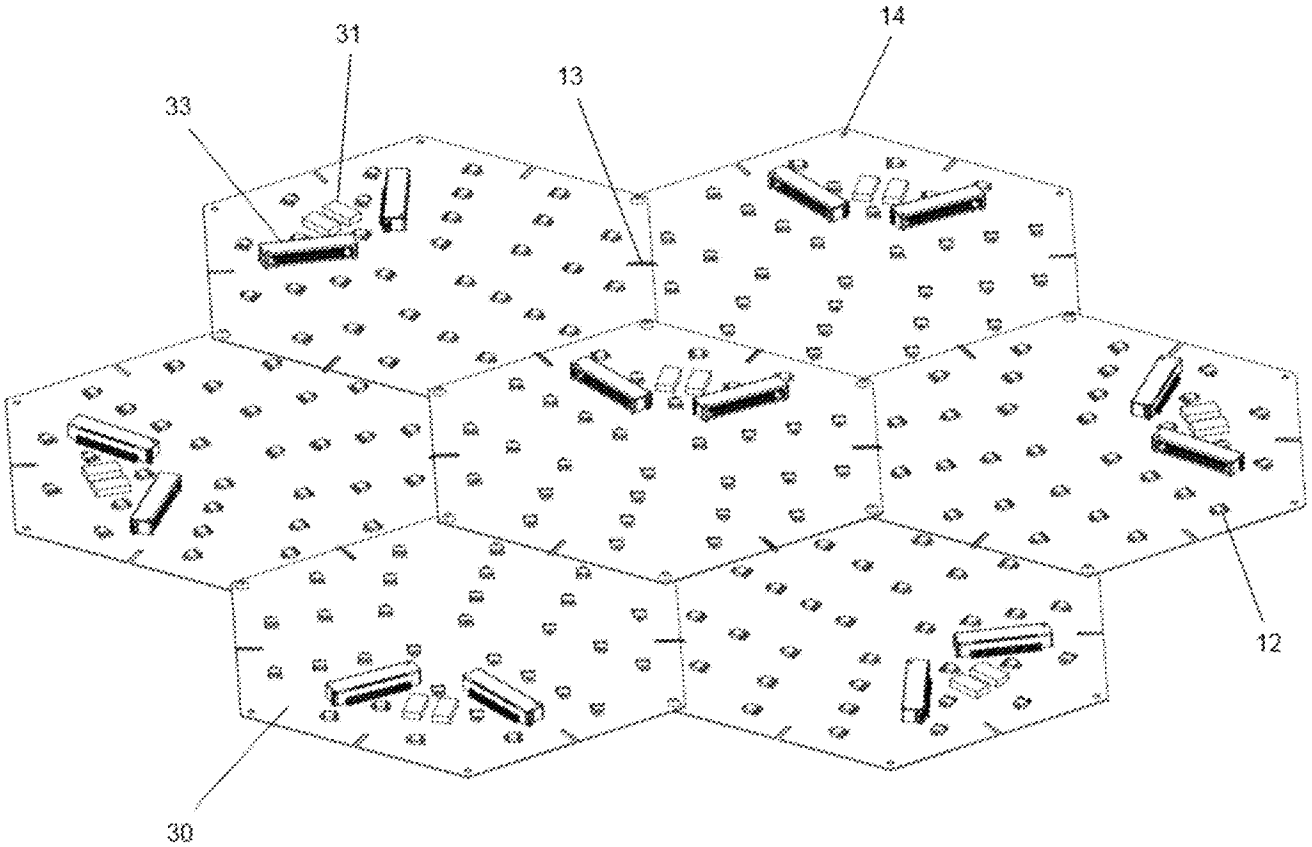
FIG. 2 is an isometric illustration of an embodiment of the invention with multiple connected tiles operating as a single directional audio array.

Referring now to the invention shown in FIG. 2, multiple tiles 10 are connected together in any desired arrangement to fit the physical aperture available given the host device that it will be installed on or in.

In more detail, still referring to the invention of FIG. 2, multiple tiles 10 are mechanically connected together by interlacing their slots 13 and overlapping and aligning their holes 14. Plastic or other fasteners can be inserted in the overlapping and aligned holes to secure them in place. Multiple tiles 10 are electrically connected together by daisy-chaining the interconnection cables 32 using the I/O connectors 33 of each tile 10.

Figure 4:
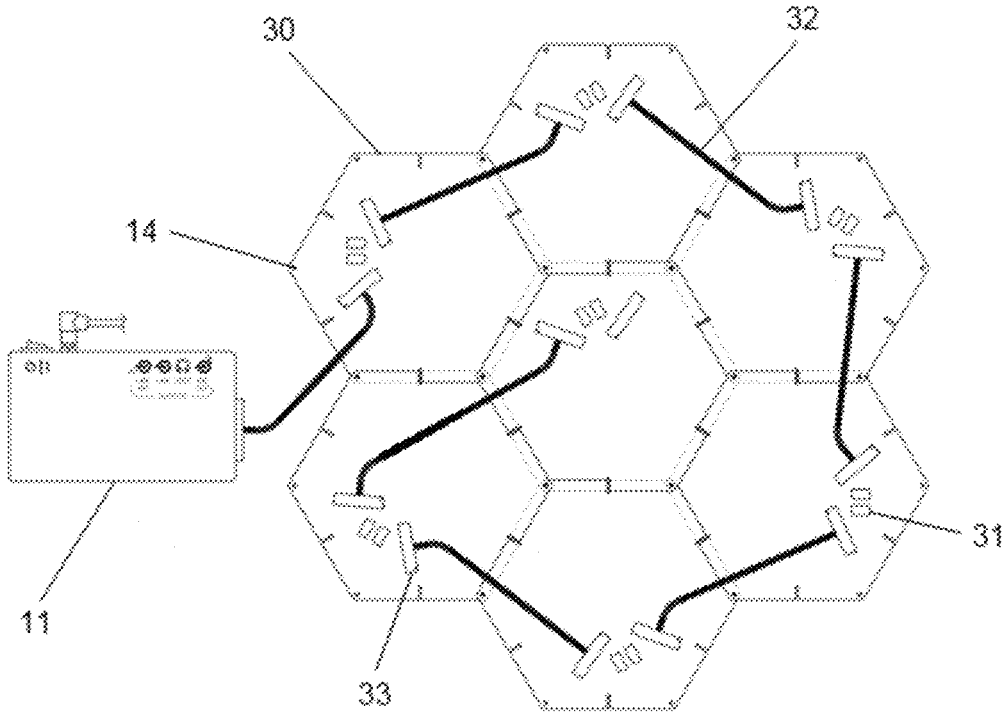
FIG. 4 is an illustration of an embodiment of the invention with an electronics module and multiple tiles connected physically and electrically, operating as a single directional audio array.

The construction details of the invention as shown in FIG. 4 are, in its preferred embodiment, flexible PCB tiles 10 that are slotted together and then secured using removable plastic fasteners inserted into holes 14.

The distance of the outer microphones from the edge of the tile 10 is typically such that if additional tiles are connected to this tile, then the distance from this tile's outer microphones to the outer microphones on the immediately adjacent tile(s) continues the appropriate distance relationship of spacing between the microphones on any one tile, whether it be fractal, golden ratio, Fibonacci, random, etc. The overall array transducer spacing may be modified by rotation of the tiles relative to each other to accomplish the elimination of any and all axes of symmetry—this is particularly important for patterns not based on mathematical sequences but may be employed for any and all patterns. Employing rotation of the tiles relative to each other to avoid undesirable geometrical symmetries of the transducer patterns reduces undesirable side lobes in the directivity pattern.

Other variations on this construction technique may include, but are not limited to, use of other transducer types (e.g. loudspeakers, vector sensors, and velocity sensors); array tiles constructed of meshes of transducers joined by conductors; wireless microphones embedded or attached to garment or other device acting as a carrier or substrate; hard PCB tiles abutting to each other, connected electrically using jumpers, and fastened to a surface using screws or bolts through holes in the tiles; and the use of digital transducers (e.g. microphones with a digital output).

Figure 3:
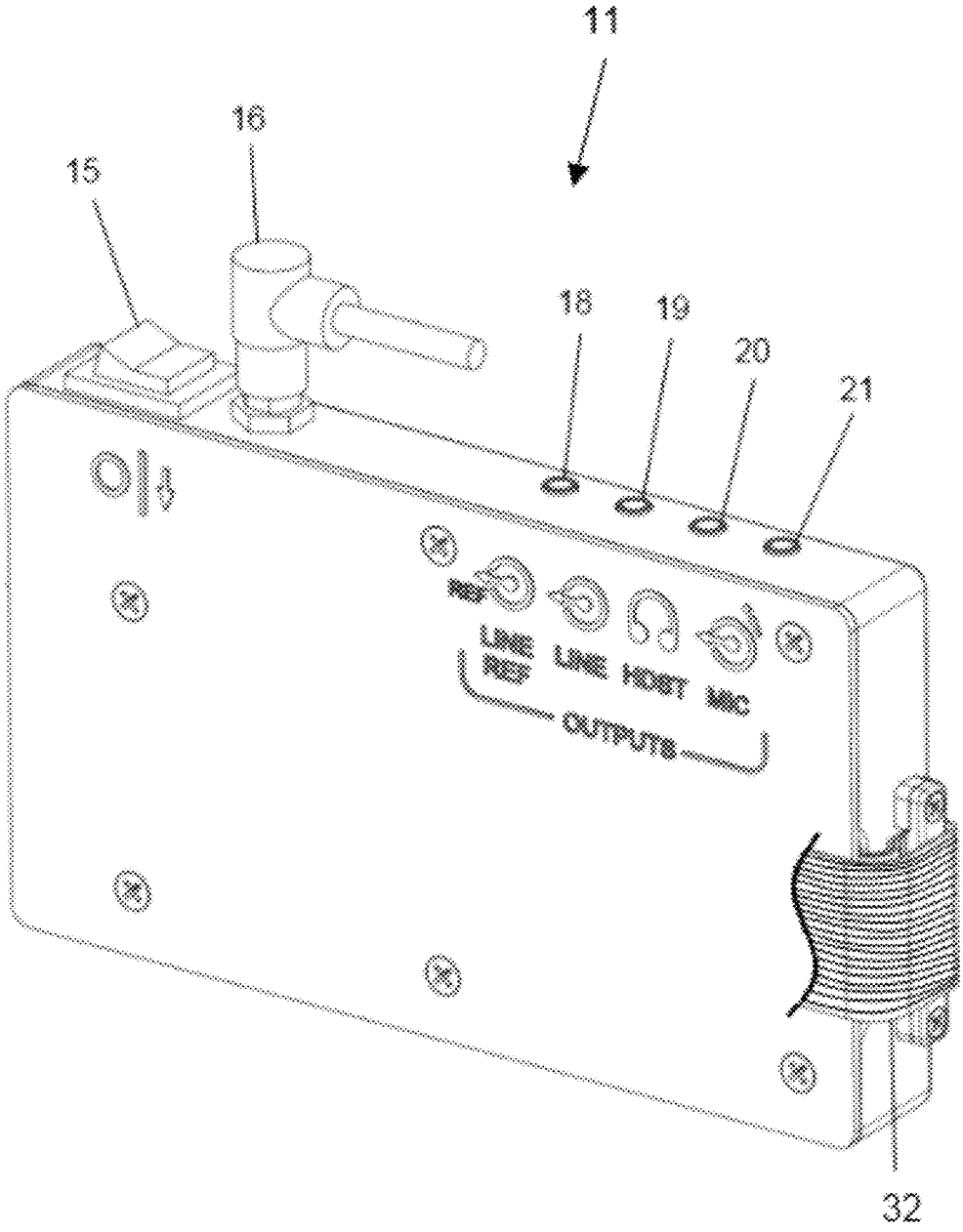
FIG. 3 is an isometric illustration of an embodiment of the invention's electronics module.

Referring now to the invention shown in FIG. 3, the electronics module connects to the tile or tiles in the array using the same electrical bus used to interconnect the tiles. In more detail, still referring to the invention of FIG. 3, the electronics module includes circuitry and other components to allow it to perform spatial filtering, linear and automatic gain control, noise reduction filtering, and signal output at multiple levels, including microphone, headphone, and/or line levels. It also provides for input and output of a general reference microphone channel, which is not beamformed and provides a representation of the sounds reaching the array or its vicinity, depending on the location of the reference microphone. The electronics module includes an on/off switch 15 and cable connection 16, which provides DC power from a remote battery pack or other electrical power source. In addition, the housing of electronics module 11 provides an output connection interface for a microphone 21, headset 20, line 19, and reference line 18.

The construction details of the invention as shown in FIG. 3 are, in its preferred embodiment, an external housing, encasing a multi-layer PCB with accompanying switch, electrical jacks, and wiring. The filtering and other processing performed on the PCB are accomplished using primarily analog electronic components.

Other variations on this construction technique have been conceived of or prototyped by the inventor, including but not limited to embedding the electronics contained in the electronics module housing inside of other housings or devices; using digital electronics, including DSPs (digital signal processors), ASICs (application specific integrated circuits), FPGA (field programmable gate arrays) and similar technologies, to implement generally the same signal processing using digital devices as is being accomplished using analog and hybrid devices in the preferred embodiment.

Referring now to the invention shown in FIG. 4, the tiles 10 are interconnected physically and electrically with each other and then electrically to the electronics module 11. In more detail, still referring to the invention of FIG. 4, the tiles 10 are cabled together using the I/O connectors 33. Each tile 10 is uniquely identified by its own channel which is manually configured by the DIP switch 31 settings. One and only one tile should also have its terminating DIP switch 31 set to "on", indicating that it is the only channel to be treated as the last tile by the electronics module 11.

The construction details of the invention as shown in FIG. 4 are, in its preferred embodiment, a wired interconnection between tiles with a remote electronics module. Other variations on this construction technique include the use of wireless links to replace one or more cables; the integration of the electronics contained in the electronics module onto an array tile; and the addition of more tiles than are supported directly by the number of conductors in the interconnection cables by setting the channel selection DIP switches so that multiple tiles share the same channel and thereby cause them to combine (beamform) their signals directly on the interconnection bus.

Figure 5:
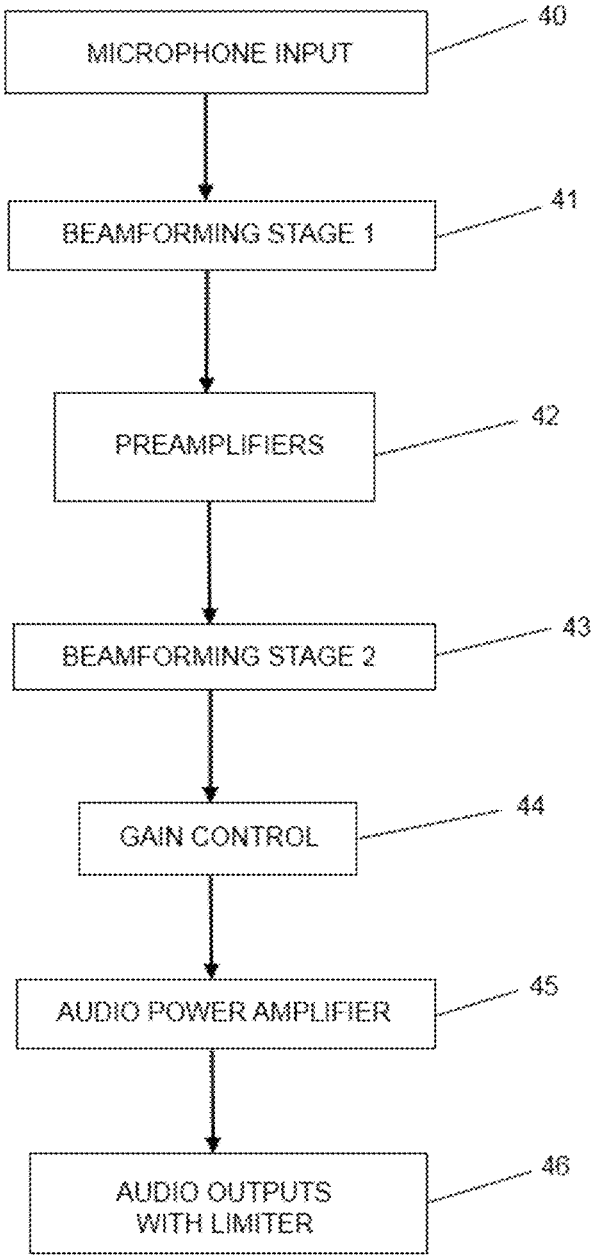
FIG. 5 is a functional block diagram of an embodiment of the invention.

Referring now to the invention shown in FIG. 5, the functional block diagram illustrates how the invention in its preferred embodiment acquires the sounds from the environment, processes them to filter out directional sounds of interest, and outputs the directional sounds for the user.

In more detail, still referring to the invention of FIG. 5, multiple microphones first capture the sounds at the array 40 and then the microphone signals are beamformed in groups in a first stage of beamforming 41 directly on the electrical bus of the tile(s) into one or more channels. In the electronics module 11 the pre-beamformed channel or channels are amplified 42 and then, if more than one channel is active, beamformed again in a second stage of beamforming 43. Linear or automatic gain control (which also includes frequency filtering) 44 and audio power amplification 45 are then applied selectively prior to the directional audio being produced at line, microphone or headphone level 46.

Other variations on this construction technique include adding successive stages of beamforming; alternative orders of filtering and gain control; use of reference channel signals to remove directional or ambient noises; use of time or phase delay elements to steer the directivity pattern; the use of digital microphones and digital signal processing to accomplish the same general technique; the addition of digital time or phase delays to add an electronic steering component to the directional microphone array; and the use of one or more signal separation algorithms instead of one or more beamforming stages.

The advantages of the present invention include, without limitation, (a) modular (tiled) or non-tiled construction
(b) highly directional audio system
(c) bi-directional audio system
(d) consistent directionality over frequency
(e) ability to easily scale and reconfigure
(f) immunity to noises caused by RF interference and mechanical rubbing
(g) low cost of construction
(h) high reliability
(i) tolerant to a wide range of temperature
(j) light weight
(k) simplicity of operation
(l) simple interconnection of tiles
(m) ability to beamform additional tiles directly upon the electrical interconnection bus
(n) simultaneous high gain, high directivity, and high side lobe attenuation
(o) low power consumption In broad embodiment, the present invention is a directional audio array that is scalable while retaining its desirable properties and introducing fewer undesirable properties than prior devices.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the appended claims.

What is claimed is:

1. A directional transducer array apparatus comprising:
a printed circuit board substrate, the printed circuit board substrate being configured in a polyhedron shape such that the printed circuit board substrate is capable of being interconnected with one or more additional printed circuit board substrates;
a plurality of transducers mounted on a surface of the printed circuit board substrate configured such that spacing between each transducer in the plurality of transducers is defined according to a fractal-based mathematical sequence;
at least one input-output connector operably engaged with the plurality of transducers through an electrical bus; and,
at least one dual in-line package switch operable to select channel settings on an electronics module.

2. The directional transducer array apparatus of claim 1 wherein the plurality of transducers are selected from the group consisting of acoustic sensors, acoustic renderers, and digital transducers.

3. The directional transducer array apparatus of claim 1 wherein the spacing between each transducer in the plurality of transducers is defined such that the fractal-based mathematical sequence is continued onto an interconnected printed circuit board substrate.

4. The directional transducer array apparatus of claim 1 further comprising an electronics module operably engaged with the plurality of sensors through an electrical bus, the electronics module comprising:
electronic circuitry operable to perform spatial filtering, linear and automatic gain control, noise reduction filtering, and signal output on at least one level.

5. The directional sensor array apparatus of claim 1 further comprising a plurality of sound ports on the printed circuit board substrate arranged in substantial alignment with the plurality of transducers.

6. The directional transducer array apparatus of claim 1 further comprising a plurality of connection apertures on a perimeter of the printed circuit board substrate.

7. The directional transducer array apparatus of claim 1 further comprising a sound absorbing layer in contact with a first surface of the printed circuit board substrate.

8. A directional transducer array system comprising:
an array tile, the array tile being configured in a polyhedron shape and interconnected to one or more identical array tiles the array tile comprising:
a plurality of transducers mounted on a surface of the array tile, wherein spacing between each transducer in the plurality of transducers is defined according to a fractal-based mathematical sequence such that all axes of symmetry between the plurality of transducers are substantially eliminated in relation to the one or more interconnected array tiles, a plurality of sound ports in substantial alignment with the plurality of transducers, at least one input-output connector operably engaged with the plurality of transducers through an electrical bus, and, at least one dual in-line package switch operable to select channel settings on an electronics module; and, at least one electrical bus operably engaged with the input-output connector of the array tile and an input-output connector of the one or more identical array tiles.

9. The directional transducer array system of claim 8 wherein the spacing between each transducer in the plurality of transducers is defined such that the fractal-based mathematical sequence is continued between the one or more interconnected array tiles.

10. The directional transducer array system of claim 8 wherein the plurality of transducers are selected from the group consisting of microphones, loudspeakers, and digital transducers.

11. The directional transducer array system of claim 8 further comprising a sound absorbing layer in contact with a first surface of the array tile.

12. The directional transducer array system of claim 8 further comprising an electronics module operably engaged with the plurality of sensors through an electrical bus, the electronics module comprising:

electronic circuitry operable to perform spatial filtering, linear and automatic gain control, noise reduction filtering, and signal output on at least one level.

13. The directional transducer array system of claim 8 wherein the one or more identical array tiles are mechanically interconnected through an interface with a plurality of interconnection apertures.

14. The directional transducer array system of claim 9 wherein the plurality of transducers mounted on the surface of the array tile are arranged such that a plurality of outer transducers on the array tile are spaced such that a plurality of outer transducers on an immediately adjacent interconnected array tile continue the predetermined mathematical sequence of the plurality of transducers.

15. The directional transducer array sensor of claim 12 wherein the electronics module is integrated onto a surface of the array tile.

16. A directional transducer array system comprising:

a plurality of transducer mounted on a host device and arranged in a nested circle configuration such that spacing between each transducer in the plurality of transducers is defined according to a fractal-based mathematical sequence, the plurality of transducers operable to capture and array process sound waves onto an electrical bus into at least one channel;

at least one input-output connector operably engaged with the plurality of transducers through the electrical bus;

at least one dual in-line package switch operable to select the at least one channel; and, an electronics module operable to amplify at least one pre-beamformed channel and selectively apply gain control to directional audio produced at an output device.

17. The directional sensor array system of claim 16 wherein the plurality of transducers are selected from the group consisting of acoustic sensors, acoustic renderers, and digital transducers.

18. The directional transducer array system of claim 16 further comprising a sound absorbing layer in contact with a surface of the host device.

19. The directional transducer array system of claim 16 wherein the electronics module further comprises phase delay elements operable to steer a directivity pattern.

20. The directional transducer array system of claim 17 wherein the plurality of transducers are housed in a physical aperture of the host device.

* * * * *